US006167141A

United States Patent [19]

Yoest

[11] Patent Number: 6,167,141

[45] Date of Patent: Dec. 26, 2000

[54] MULTIMATERIAL HEARING AID HOUSING

[75] Inventor: Robert S. Yoest, Northbrook, Ill.

[73] Assignee: Beltone Electronics Corporation, Chicago, Ill.

[21] Appl. No.: 09/070,124

[22] Filed: Apr. 30, 1998

[51] Int. Cl.[7] ..... H04R 25/00

[52] U.S. Cl. ..... 381/322; 381/328

[58] Field of Search ..... 381/322, 324, 381/327, 328, 330, 380, FOR 133, FOR 135; 264/222; 181/129, 130, 135

[56] References Cited

U.S. PATENT DOCUMENTS

| | | |
|---|---|---|
| 789,876 | 5/1905 | Pape . |
| 1,830,198 | 11/1931 | French . |
| 2,521,414 | 9/1950 | Schier . |
| 2,535,258 | 12/1950 | Bland . |
| 2,908,343 | 10/1959 | Hummert . |
| 3,345,737 | 10/1967 | Gordon . |
| 4,617,429 | 10/1986 | Bellafiore . |
| 4,800,636 | 1/1989 | Topholm . |
| 4,834,927 | 5/1989 | Birkholz et al. . |
| 4,869,339 | 9/1989 | Barton . |
| 4,870,688 | 9/1989 | Voroba et al. . |
| 4,871,502 | 10/1989 | LeBisch et al. . |
| 4,937,876 | 6/1990 | Biermans . |
| 4,962,537 | 10/1990 | Basel et al. . |
| 5,002,151 | 3/1991 | Oliveira et al. . |
| 5,321,757 | 6/1994 | Woodfill, Jr. . |
| 5,530,763 | 6/1996 | Aebi et al. . |
| 5,654,530 | 8/1997 | Sauer et al. . |

FOREIGN PATENT DOCUMENTS

| | | |
|---|---|---|
| 17 79 936 U | 10/1959 | Germany . |
| 1231304 | 12/1966 | Germany . |
| 79 29 224 U | 10/1979 | Germany . |
| 79 29 226 U | 10/1979 | Germany . |
| 9-65493 | 3/1997 | Japan . |
| 9-65494 | 3/1997 | Japan . |
| WO 93/25053 | 12/1993 | WIPO . |

OTHER PUBLICATIONS

Krogh et al., "Various Types of Earmolds . . . ," Hearing Aid Fitting Theoretical and Practical Views, 13th DanaVox Symposium, 1988, pp. 429–437.

*Primary Examiner*—Huyen Le
*Attorney, Agent, or Firm*—Rockey, Milnamow & Katz, Ltd.

[57] ABSTRACT

A hearing aid housing which is formed of a substantially rigid plastic material carries a deformable compliant region. The region, which could be in the form of an annular seal, or which could extend in part axially along the housing improves user comfort and hearing aid performance by providing an improved seal with the user's ear canal. The housing can be formed with a substantially constant wall thickness which includes the regions wherein the compliant material is located.

16 Claims, 6 Drawing Sheets

MULTIMATERIAL HEARING AID HOUSING

FIELD OF THE INVENTION

The invention pertains to hearing aids. More particularly, the invention pertains to housings for hearing aids which incorporate compliant comfort improving and seal improving regions.

BACKGROUND OF THE INVENTION

Two major related problems are often associated with known hearing aids. These are feedback and poor physical fit or discomfort. Both of these problems may result in hearing aids being returned to the manufacturer to be remade or returned for credit.

If a hearing aid does not make a good seal in the ear, oscillation producing feedback usually occurs. This results in a device whose gain can not be turned up sufficiently to provide the user with the needed amplification.

A poor fit can be the result of, among other causes, sensitivity in the bony portion of the ear canal, an imperfect impression of the ear canal, variability in the shell manufacturing process, or ear anomalies such as bumps or birthmarks. A poor fit will reduce user satisfaction and promote a return or non-use of the instrument.

Hearing aids are conventionally tested by mounting each unit in putty and completely sealing it on a standard test coupler. The performance of the mounted unit is then measured. If the unit is within its specifications, it is then shipped to the customer.

If the hearing aid does not produce an adequate seal in the user's ear, the device's potential can not be achieved. Additionally, when the human jaw moves due to talking, chewing, etc., the shape of the ear canal changes. A rigid, conventional shell cannot adjust for the changes in ear canal shape due to movement of the jaw. Hence, an entirely rigid hearing aid shell that is perfectly fitted initially may produce unsatisfactory results in normal use.

Thus, there continues to be a need for hearing aid shells which can provide better seals than heretofore known. Preferably such improved seals could provide comfortable fit under both static and dynamic conditions of use.

SUMMARY OF THE INVENTION

A housing for a hearing aid has improved seal and comfort characteristics under both static and dynamic conditions. These are achieved by combining a relatively rigid plastic with a more compliant elastomer. The resultant multimaterial housing can include one or more compliant, comfort enhancing regions which are in contact, when inserted, with more sensitive regions of a user's ear canal.

Alternately, or in addition thereto, compliant annular seals can be formed around the housing. When inserted, the annular compliant region provides an improved, comfortable seal with the interior of the user's ear canal. As a result of these improved characteristics, the gain of the unit can be increased without producing performance degrading feedback.

In yet another aspect, the housing, which defines a hollow interior region for carrying various types of electrical components, is formed with a substantially constant wall thickness. The regions of the housing which are intended to receive the compliant material are also formed with substantially the same wall thickness.

These constant wall thicknesses are achieved as a result of casting the rigid portion of the housing with the compliant material receiving regions defined thereon. This in turn produces a substantially rigid cast housing which has not been stressed or weakened due to having material removed therefrom (thereupon reducing the wall thickness) after the casting process has been completed.

A method in accordance with the present invention includes the steps of: forming a relatively soft impression of the ear canal of a user; removing from the user's ear canal impression a limited amount of material in the regions to be defined to receive the compliant insert; forming an inverse or female mold corresponding to the ear canal impression; and casting in that mold a substantially rigid housing, for example of acrylic.

The housing formed as above will incorporate the predefined compliant material receiving regions. Those regions will have a wall thickness comparable to the wall thickness of the remainder of the housing.

A compliant material can be deposited into those regions, in a gel or liquid form and then permitted to harden. When hardened, the comfort enhancing regions or improved seal will make it possible to comfortably wear or to operate the unit at higher gain levels without causing physical discomfort due to fit or feedback problems.

In another aspect, the invention addresses a need for a hearing aid that seals in the ear canal better and is more comfortable than those that are available today. The preferred embodiment of the hearing aid can be fabricated using most of the same materials and manufacturing techniques used today. The invention can be used on all types of custom hearing aid styles such as in-the-ear, in-the-canal, minicanals, or completely-in-the-canal styles.

A raw canal impression is produced and processed as is known in the industry today. After the impression has been sculpted into a configuration usable to produce an ear mold or shell, a channel or recess is formed in the outer surface of the impression. The channel or recess can be formed using a machining process.

In one embodiment, a channel roughly 0.020" deep entirely encircles the output end of the housing. This channel may be round or elliptical, concentric with the canal, or on a diagonal. The shell is then cast in a conventional fashion. The resulting shell has the channel formed therein. The wall thickness in the vicinity of the channel corresponds to the wall thickness elsewhere on the housing.

The hearing aid assembly is completed. Once the unit has been assembled, the channel is filled with a flexible, soft, and durable material preferably a silicone. The channel could be oversized to produce a superior seal.

An alternate embodiment incorporates a soft region on the hearing aid shell. This region is used to provide soft contact in a sensitive area of the ear. This soft or compliant region is produced in much the same way as is the above described channel except that it will not be overfilled to create a protrusion. It will only be filled until the recess has been built up to correspond to the surface of the original impression. The method can be modified such that the housing wall thickness in the vicinity of the compliant material is greater than or less than the wall thickness of the remainder of the housing.

In yet another aspect, the housing can also be formed of a compliant material.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1A:
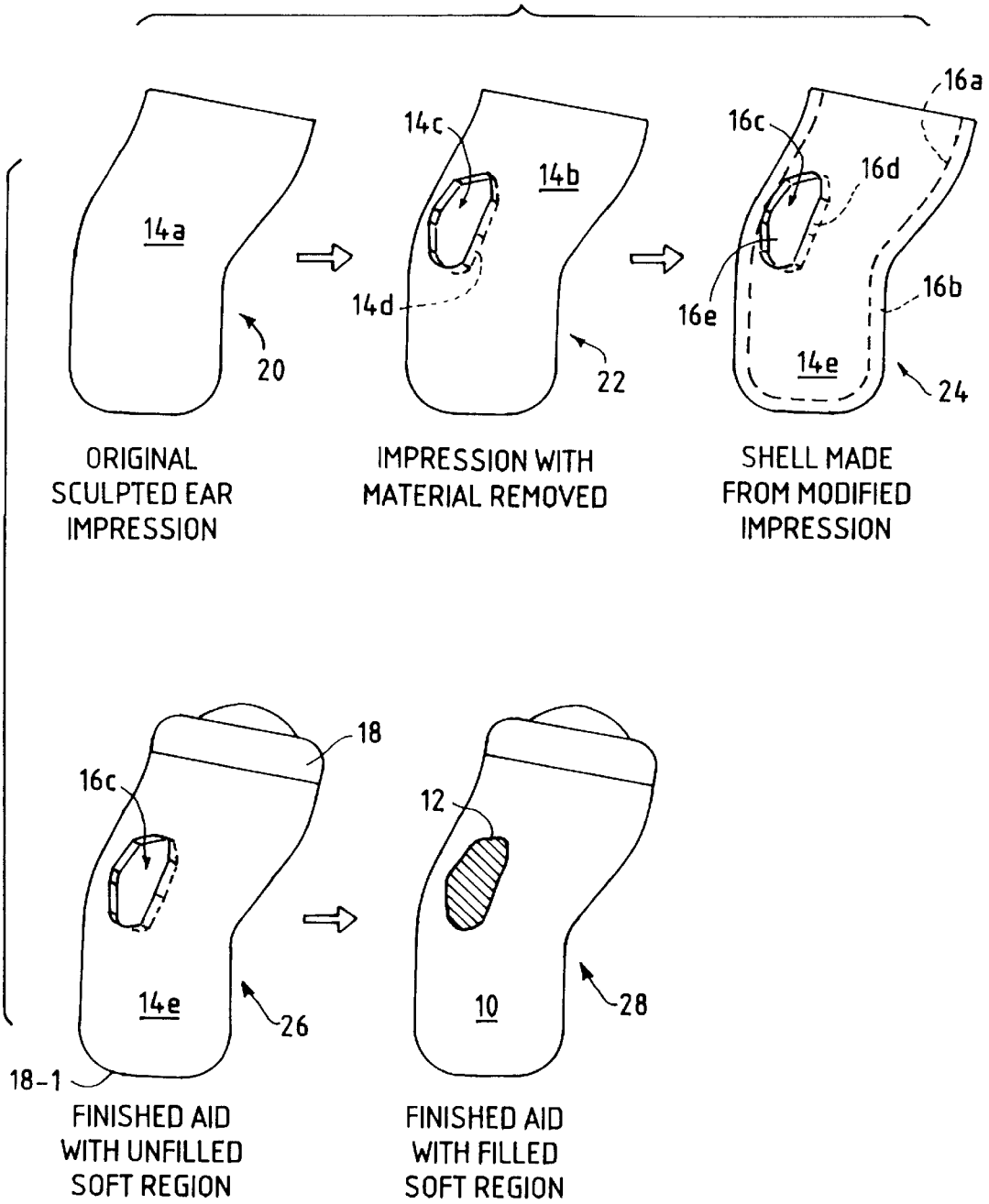
FIGS. 1A and 1B taken together illustrate a process of forming a multimaterial hearing aid housing in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1A illustrates the steps of a process for forming an improved hearing aid 10 with a comfort improving compliant region 12. In an initial step 20, an ear impression 14*a* is formed using conventional materials. The impression 14*a* corresponds to the shape of an ear canal of a selected potential user.

In a step 22, the impression 14*a* has been processed to form an impression 14*b*. In the impression 14*b*, material has been removed adjacent the surface thereof so as to form a region 14*c*, of a selected depth 14*d* therein.

The modified impression of 14*b* is then used in a conventional casting process to form an inverse or female casting mold indicative thereof. That mold, not shown, is then used to form, using conventional molding processes, a substantially rigid, hollow acrylic shell 14*e* in a step 24.

The shell 14*e* defines an interior component receiving region 16*a*. The component receiving region 16*a* is bounded by a shell wall 16*b* of a substantially constant thickness.

The region 14*c* has been replicated in the shell 14*e* as a cast region 16*c*. The region 16*c* should have the same dimensions and shape as does the region 14*c*.

The region 16*c* has a depth 16*d* corresponding to the depth 14*d* of the region 14*c*. The region 16*c* is bounded by a surface 16*e*. The depth of the rigid cast material adjacent the bounding surface 16*e* corresponds to the wall thickness 16*b*.

An audio or speech processing electronics package can be installed in the shell 14*e*. The shell 14*d* can be closed with a faceplate 18 illustrated in a step 26. Processed audio is output from an output port formed on an end 18-1. The end 18-1 would be inserted into the user's ear canal.

In a final step 28, the region 16*c* can be filled with a compliant material 12 thereby forming completed housing 10. Alternately, as would be understood by those having skill in the art, the appropriate electronic package can be installed into the housing 10 subsequent to having applied the material 12.

Figure 1B:
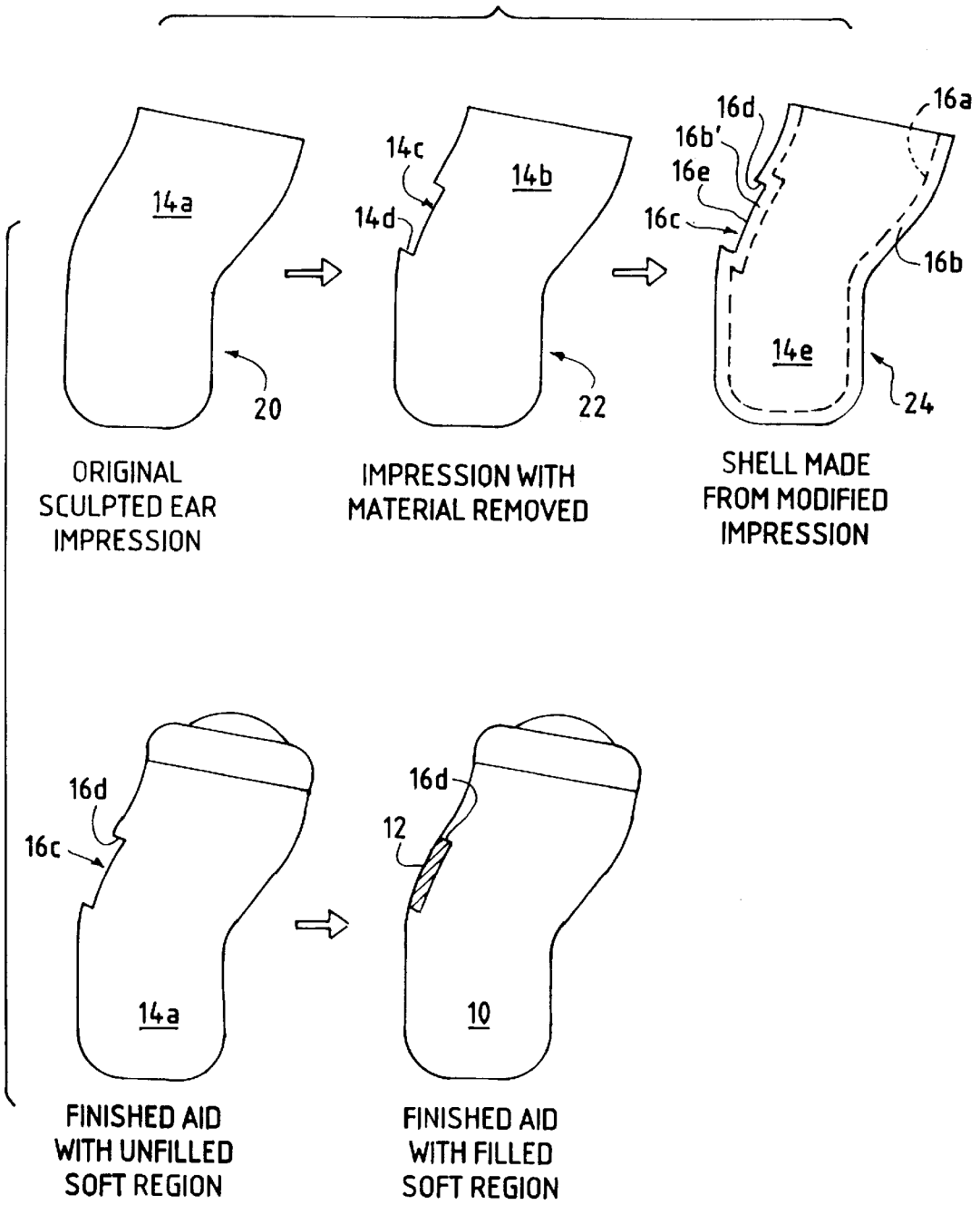

FIG. 1B illustrates the steps 20 through 28 with the elements 14*a*, 14*b*, 14*e* and 10 rotated. As illustrated in step 22 of FIG. 1B, the region 14*c* has been cut into the ear impression with a depth 14*d*. The subsequently manufactured shell, 14*e*, is thus formed with a region 16*c* having a depth 16*d*.

The wall thickness 16*b*' of the shell 14*e* in the vicinity of the region 16*c* is substantially the same as the thickness 16*b* formed elsewhere in the shell. Thus, when the shell 14*e* has been cast, the depression 16*c* formed therein has associated therewith the same wall thickness as the remainder of the shell and does not represent a region of thinner wall thickness which might fracture or break in response to stresses applied during normal use. It will be understood that greater or lesser wall thicknesses, such as 16*b*' can be formed without departing from the spirit and scope of the present invention.

Figure 2:
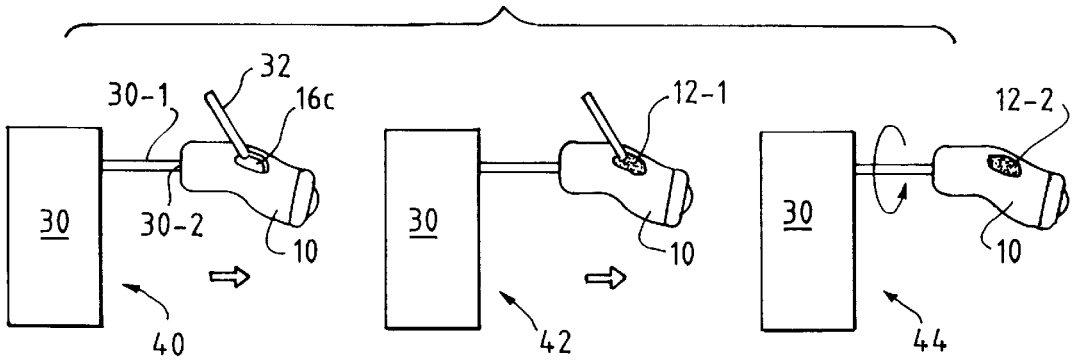
FIG. 2 illustrates steps of a process of curing an applied compliant material.

FIG. 2 illustrates steps of an exemplary method for applying the elastomeric material 12 to the housing 10 so that it flows uniformly throughout the region 16*c*. In a step 40, the housing 10 is mounted on a fixture 30. Mounting can be accomplished by inserting a barb, pin or other attachment device 30-1 into an audio output port or vent 30-2.

The compliant material 12 is applied in flowable form to the region 16*c* by means of a syringe or applicator 32 in a step 42. Once the flowable material 12-1 has been applied to the region 16*c*, in a step 44, the fixture 30 rotates the housing 10.

Rotating the housing 10 produces a flow of the material 12-2 throughout the region 16*c* while permitting the material to harden. The rotation also promotes hardening of the material 12-2 at a uniform thickness and minimizes or prevents pooling or dripping thereof, by minimizing the distorting effects of gravity, until the material 12-2 has solidified to the point where it will no longer readily flow.

In a finishing step, not illustrated, the material 12-2 can be completely cured by exposing the housing 10 to radiant heat, ultrasonic heating, ultraviolet light or other curing techniques to complete the curing process and to provide a solidified, compliant region 12. Though cured, the selected elastomeric material will still be softer and more compliant than the remainder of the housing or shell 10.

As those of skill in the art will understand, the shell 14*e* can be formed undersized to a predetermined extent either by coating the inside of a negative or female mold formed off of the impression 14*b* using material such as wax and then casting the shell 14*e* within that coated mold. Alternately, a layer of material can be removed from the impression 14*a* prior to forming the region 14*c*.

As illustrated in FIG. 1B, the final exterior contour of the cured region 12 corresponds to the exterior contour of the shell 10.

The curable material 12 can be any form of medical grade curable, compliant, silicone, polyurethane, polyvinyl or other elastomer. By appropriate selection of color, as will be understood by those of skill in the art, the complaint region 12 can be formed so as to be indistinguishable from the rigid housing 14*e*.

Figure 3:
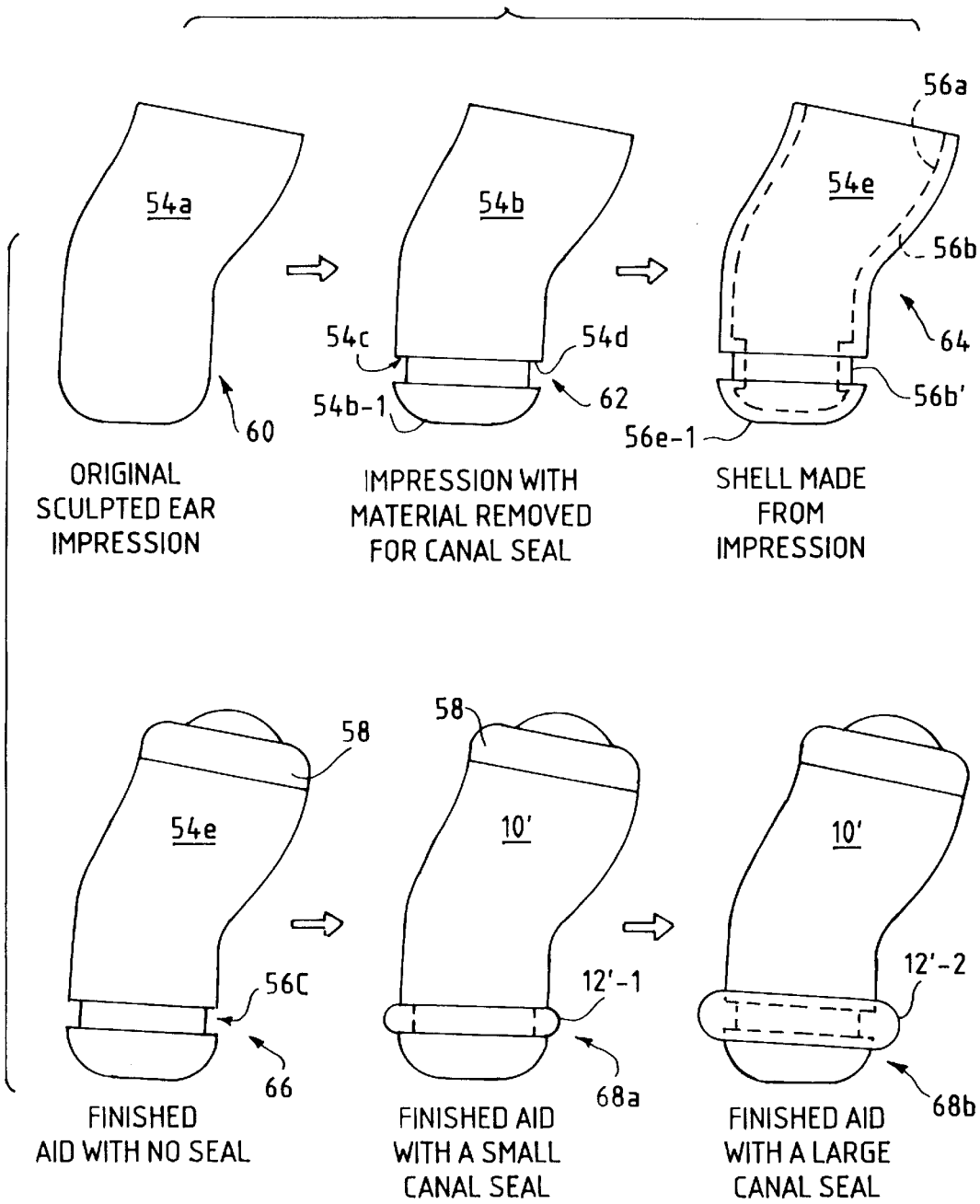
FIG. 3 illustrates the steps of a process of forming a compliant annual seal in accordance with the present invention.

FIG. 3, unlike the process illustrated in FIGS. 1A, 1B which forms a comfort enhancing compliant region 12 on a shell 10, illustrates a process of forming a rigid shell 10' which carries an annular compliant seal such as 12'-1 or 12'-2. A seal 12'-1 can be formed with a first lateral extent and a first axial dimension. Alternately, an over-sized seal 12'-2 can be formed with a greater lateral extent and a greater axial dimension.

In a step 60, as illustrated in FIG. 3, a sculpted ear impression 54*a* can be formed corresponding to the shape of the ear canal of a selected user. In a step 62, the impression at 54*b* has been processed by removing material to form an annular depression or region 54*c* which is located adjacent to an audio output end 54*b*-1 of the impression 54*b*.

The end 54*b*-1 corresponds to the end of the impression 54*b* which, when cast, is intended to be inserted into the ear canal adjacent to the ear drum of the user. Hence, an acoustic output port would be formed in the end 54*b*-1 to permit processed audio to emanate from the housing 54*b*.

The processed impression 54*b* is then used to form a negative or a female mold as would be understood by those of skill in the art. That mold is in turn used in a step 64 to form a rigid hollow acrylic shell 54*e*.

The shell 54*e* which results from the casting process defines an internal component receiving region 56*a* and has a substantially constant wall thickness 56*b*. The wall thickness 56*b*' is substantially the same constant value in the region 56*c* which corresponds to the annular seal receiving region 54*c*. Greater or lesser wall thicknesses, as 56*b*' could also be used.

As would be understood by those of skill in the art, the rigid shell 54*e*, when completed as a hearing aid, is intended to be inserted into the ear canal of the user. An end 56*e*-1 of the shell 54*e* would be located in the ear canal adjacent to the user's ear drum.

As will be described subsequently, a seal formed in the annular channel 56*c* will be effective to seal with the interior surface of the user's ear canal thereby minimizing the possibility of feedback. As a result, the completed unit can be operated at a high gain thereby providing additional amplification for the benefit of the user.

In a step 66, the electronic package for processing audio can be installed in housing 54*e* and the housing 54*e* can be completed with a faceplate 58. Finally, in a step 68*a* or 68*b* a curable compliant annular seal 12'-1 or 12'-2 can be formed in the channel 56*c*. The seal 12'-1, 12'-2 is permanently attached to the housing 10' . As illustrated in the step 68*a*, 68*b*, the cured seals 12'-1, 12'-2 are uniformly distributed, and solidified thereby forming a compliant seal. Alternately, the electronic package can be installed in the region 56*a* subsequent to forming the seals 12'-1, 12'-2. The time of installation of the electronic package is not a limitation of the present invention.

Figure 4:
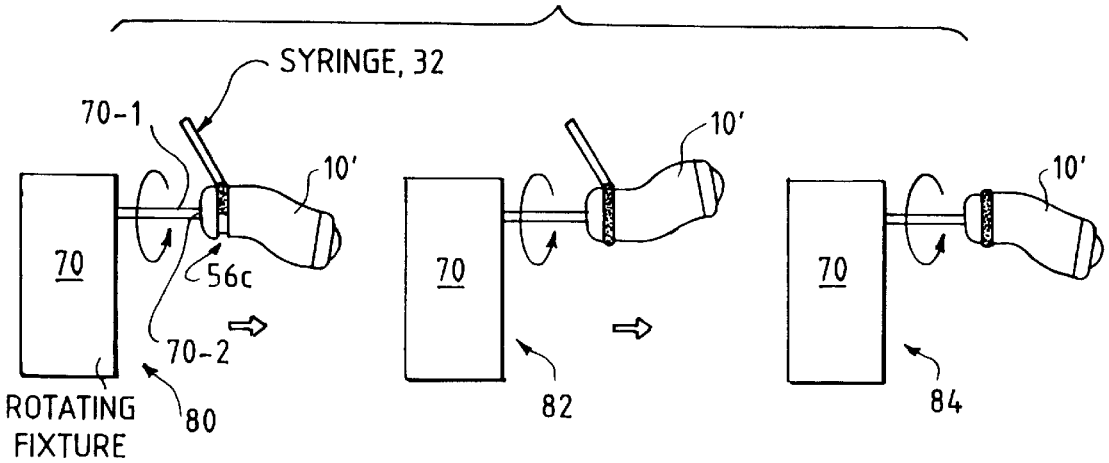
FIG. 4 illustrates the steps of curing the seal of FIG. 3.

FIG. 4 illustrates the steps of a process of applying the compliant material to the channel 56*c* so as to form the desired annular seal 12'1, 12'-2.

As illustrated in FIG. 4 in a step 80, a rotating fixture 70 is used to support the housing 10' in a rotary fashion. A syringe or applicator 32 can be used to inject a flowable, curable, compliant material, such as silicone, into the channel 56*c* to form the seal.

The housing 10' can be supported on the fixture 70 by a barb, pin, or other attachment device 70-1 which is inserted into the vent or audible output port 70-2 at the end 56*e*-1. As illustrated in the step 80, the housing 10' is to be slowly rotated while the syringe or dispenser 32 applies flowable silicone or other compliant material into the channel 56*c*.

As illustrated in a step 82, the fixture 70 continues to rotate the housing 10' while the flowable compliant material is applied to completely fill the channel 56*c*. Once a sufficient amount of material, to form either the seal 12'-1 or 12'-2 has been applied to the channel 56*c*, the applicator 32 ceases applying additional material. The housing 10' continues to rotate to produce a uniform distribution of material in a channel 56*c*.

As illustrated in a step 84, the fixture 70 will continue to rotate the housing 10' until the material forming the seal 12'-1, 12'-2 has solidified sufficiently that it will no longer flow. At this time, the housing 10' can be subjected to radiant heat, ultrasonically generated heat, ultraviolet light or any other curing technique appropriate to complete the curing process of the seal 12'-1 or 12'-2.

The fixture 70 can continue to rotate the housing 10' during the remainder of the curing process. Once the seal 12'-1, 12'-2 has substantially completed curing, the housing 10' can be removed from the fixture 70.

It will be understood that a depression such as region 16*c* or annular ring 56*c* could be formed in a region of a respective housing without the housing exhibiting a substantially constant thickness adjacent thereto. For example, the wall thickness, such as the regional thickness 16*b*' , or 56*b*' , could be greater than or less than the adjacent wall thickness of the respective housing.

It will also be understood that the housing need not be rigid. One of skill in the art will recognize how the disclosed process should be modified to be used in conjunction with deformable housings. Such compliant housings could carry, for example, enlarged sealing rings such as seals 12'-1 and 12'-2 or other added compliant regions such as region 12.

Figure 5:
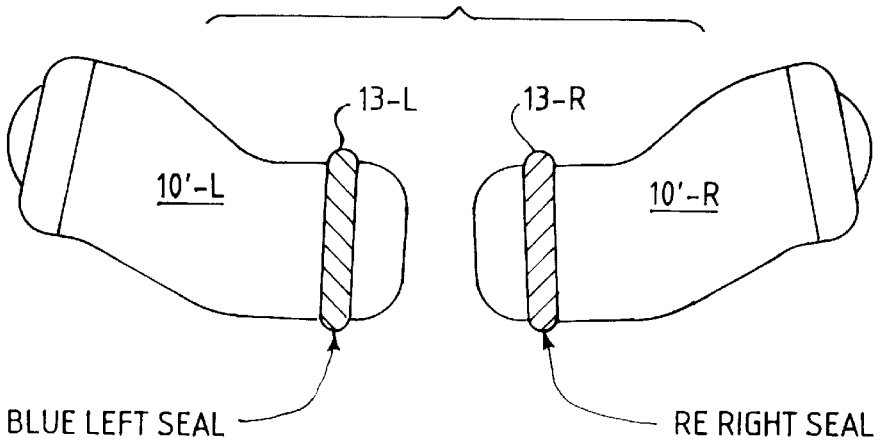
FIG. 5 illustrates a pair of color coded hearing aids.

FIG. 5 illustrates two housings 10' -L and 10' -R. The two illustrated housings are for a user's left ear and right ear respectively. Each of the housings carries a respective annular seal such as the seal 13-L and 13-R. The seals 13-L and 13-R correspond, for example, to the annular seal 12'-1 or 12'-2.

For identification and ease of use, the seal 13-L can be formed incorporating an identifying color, for example, the color blue. Similarly, the seal 13-R can be formed with an identifying color such as the color red. Such color coding provides additional convenience for the user by clearly identifying which ear is associated with the respective housing.

Figure 6A:
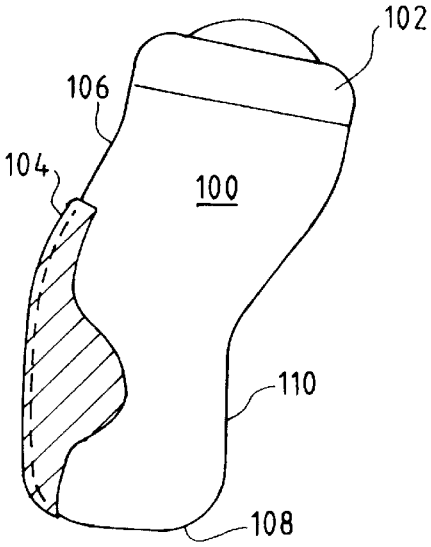
FIG. 6A illustrates a radially extending compliant region.

FIG. 6A illustrates a housing 100 having a faceplate 102. The housing 100 carries a compliant region 104 which extends at least in part axially there along. The region 104 extends laterally from an exterior of peripheral surface 106 of the housing 100.

When the end 108 is inserted into the user's ear canal, the region 104 assists in forming a seal between the housing 100 and the interior surface of the ear canal by in part deforming so-as to conform to the shape of the adjacent ear canal of the user. Additionally, to the extent that a portion of the user's ear canal compresses or deforms the material 104, which extends purposely laterally from the peripheral surface 106, an opposing peripheral region 110 will be forced against the opposing portion of the user's ear canal thereby forming a seal.

The region 104, when inserted into the user's ear canal, with the end 108 extending toward the user's ear drum, could be located adjacent to and in contact with a substantially rigid or hard portion of the ear canal. This would in turn depress or deform a portion of the compliant material 104 which in turn forces the region 110 toward and into contact with an opposing portion of the user's ear canal thereby promoting an improved seal.

Figure 6B:
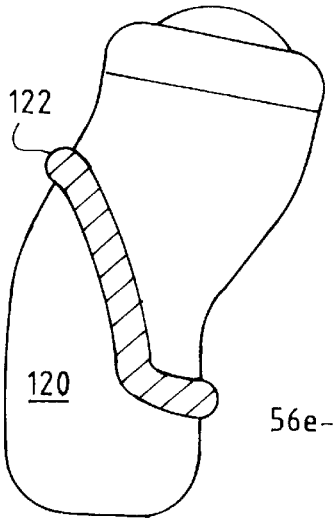
FIG. 6B illustrates a generalized form of a seal.

FIG. 6B illustrates a housing 120 which carries a generalized seal 122 formed of a compliant conformable material. It will be understood that the housing 120 could be formed of a substantially rigid plastic material. Alternately, the housing 120 could be formed of a compliant material.

Figure 7:
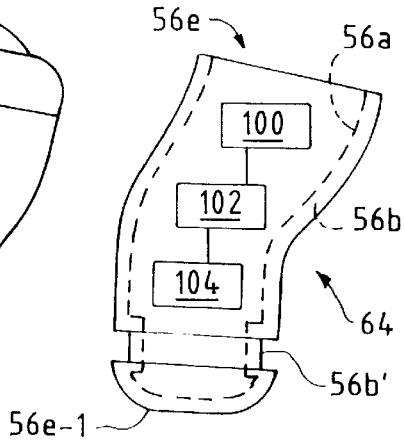
FIG. 7 illustrates a hearing aid using the shell of FIG. 3.

FIG. 7 illustrates a hearing aid using the housing 56*e* of FIG. 3. As illustrated in FIG. 7, an input transducer 100 carried by the housing 56*e* is coupled to a signal processor 102, also coupled to the housing. The signal processor 102 is in turn coupled to an output transducer 104 also carried by the housing.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A hearing aid comprising:

a housing formed of a substantially rigid material wherein the housing has an exterior peripheral surface and defines an internal component receiving region and wherein the housing defines a three dimensional region, formed adjacent to the surface, of a selected periphery; and wherein the region is filled with a flowable, compliant material which cures and bonds to the housing forming a compliant surface that intersects the exterior peripheral surface at the periphery.

2. A hearing aid as in claim 1 wherein the three dimensional region is in the form of a closed curve.

3. A hearing aid as in claim 2 wherein the compliant surface extends continuously with a smoothly changing surface gradient.

4. A hearing aid as in claim 2 wherein the compliant surface extends generally laterally from the peripheral surface of the housing a predetermined amount.

5. A hearing aid as in claim 4 wherein the closed curve is substantially circular.

6. A hearing aid as in claim 1 wherein the compliant material is substantially evenly distributed throughout the three dimensional region.

7. A hearing aid as in claim 1 wherein the compliant surface extends continuously without abrupt changes in a surface gradient.

8. A hearing aid as in claim 1 wherein the housing exhibits a substantially constant wall thickness and exhibits the same thickness in the three dimensional region.

9. A hearing aid as in claim 1 wherein the applied compliant material is distributed throughout the region in response to selected movement of the housing while the compliant material is hardening.

10. A hearing aid as in claim 1 wherein the region is color coded.

11. A hearing aid comprising:

a hollow housing having an exterior surface and at least a section having a substantially constant wall thickness;

a depression formed in the surface of the housing wherein the depression is at least filled with a flowable compliant material which hardens into an annular seal which extends from the surface of the housing;

an input transducer carried by the housing;

a signal processor, carried by the housing, coupled to the input transducer;

an output transducer, carried by the housing, and coupled to the signal processor and to an audio output port in the housing.

12. A hearing aid as in claim 11 wherein the depression is formed as an annular ring that surrounds the end of the housing containing the output port.

13. A hearing aid as in claim 11 wherein the depression extends at least in part, axially along a portion of the housing.

14. A hearing aid as in claim 13 wherein the depression is at least in part filled with a flowable material which, when cured, is softer and more deformable than the adjacent housing.

15. A hearing aid as in claim 11 wherein the housing in the vicinity of the depression, exhibits the substantially constant wall thickness.

16. A hearing aid as in claim 11 wherein the housing is formed of a substantially rigid material.

* * * * *